United States Patent [19]

Norman et al.

[11] 4,239,228

[45] Dec. 16, 1980

[54] GOLF SWING TRAINING DEVICE

[76] Inventors: Benjamin F. J. Norman, 201 - 93rd Ave., N.E., Blaine, Minn. 55434; Clifford R. Brown, 7830 NE. Jackson, Fridley, Minn. 55421

[21] Appl. No.: 23,402

[22] Filed: Mar. 23, 1979

[51] Int. Cl.[3] ..... A63B 69/36

[52] U.S. Cl. ..... 273/189 R; 128/134; 273/DIG. 30

[58] Field of Search ..... 273/188 R, 188 A, 189 R, 273/189 A; 128/133, 134

[56] References Cited

U.S. PATENT DOCUMENTS

| | | | |
|---|---|---|---|
| 1,655,092 | 1/1928 | Davis | 273/189 R |
| 3,680,869 | 8/1972 | Brady | 273/188 A X |
| 4,046,143 | 9/1977 | Bell | 128/133 |

*Primary Examiner*—George J. Marlo

*Attorney, Agent, or Firm*—Orrin M. Haugen; Thomas J. Nikolai

[57] ABSTRACT

An adjustable tether for joining the upper arms of a golfer together to coordinate the relative motion of the arms of the golfer during his swing. The arm joining tether comprises first and second generally Y-shaped flexible straps each having a stem portion which is bifurcated so as to terminate in branch portions which may be joined by suitable fasteners to form arm engaging loops. The stem portions may also be joined by a suitable two-element separable fastener and when in use, the joined stem portions span the chest of the user. It has been found that mating hook and loop type fasteners are ideally suited for joining the Y-shaped flexible strap members, one to the other, and in coupling the branch portions of each to form the aforesaid arm engaging loops. Further, each of the individual Y-shaped strap members is marked with a suitable graduated marking to facilitate the sizing of the device to golfers of different physical size.

3 Claims, 2 Drawing Figures

GOLF SWING TRAINING DEVICE

BACKGROUND OF THE INVENTION

This invention relates to a restraint which is useful during golf practice for training the golfer to coordinate the relative movement of his arms during his stroke, and more specifically to an adjustable strap arrangement which can be formed into two arm engaging loops separated by a chest spanning band, the loops being adapted to surround the upper arms of the user.

In the Davis Pat. No. 1,655,092 there is described a device designed for a related purpose, i.e., to restrain the relative motion between the two arms of a golfer during his swing in such a fashion that the golfer's elbows are maintained at a substantially constant spacing during both the downstroke and the follow through. In the device of the Davis Patent, first and second loops adapted to engage the arm are formed from a flexible strap and slide members are provided for adjusting the relative size of the loop. A hook and eye configuration is used to join portions of the two loops together proximate the center of the user's chest when the loops are placed about his upper arms. A buckle arrangement is also included for permitting one of the arm engaging loops to be adjusted in size and for providing additional strap length to accommodate users of differing chest span.

The present invention is considered to be an improvement over the device described in the Davis Patent. Specifically, the restraint device of the present invention is designed to facilitate its use on persons of differing physical size with a minimum of time and effort needed to adjust the restraint to the particular user. Then too, by eliminating the need for buckles and other metal fasteners, the device can be used without suffering irritation of the skin and/or the risk of damage to the clothing of the user.

SUMMARY OF THE INVENTION

In accordance with the teachings of the present invention, there is provided a restraint device for use in improving a golfer's swing, especially during practice. The restraint device comprises first and second Y-shaped flexible straps each having a stem portion of a predetermined length which is bifurcated to form first and second branch portions. These branch portions are provided with mating elements of a Velcro-type hook and loop fastener one element of which is disposed on the outer surface of the branch and the opposed fastener element being affixed to the inside surface of the associated branch. Hence, when the two elements of the Velcro fastener are joined one to the other, a loop is formed at one end of the stem. The stem portions of each of the Y-shaped members are further provided with a two element separable fastener of the Velcro type so that when the stem portions are fastened together the loops extend in opposite directions. Further, to facilitate the sizing of the restraint device, one branch and the stem of each of the Y-shaped members is provided with graduated markings. As such, the user can readily set the loop sizes and stem overlap to his or her own physical size. Because the need for metal fasteners, buckles, etc. are eliminated, the restraint device of the present invention is more comfortable to use over prolonged periods. Further, the absence of metal fasteners or size adjusting devices reduces the chance of snagging and tearing of the golfer's clothing during use.

OBJECTS

It is accordingly the principal object of the present invention to provide a new and improved golf swing training device.

Another object of the invention is to provide a golf swing training device which comprises a restraining system for maintaining the relative spacing between the elbows of a golfer during his stroke.

Still another object of the invention is to provide a golf swing training device wherein the arm restraining members are readily adjustable to accommodate different users.

Yet another object of the invention is to provide a arm restraint for use by golfers in which the need for metal buckles and related type joining devices is obviated.

These and other objects and advantages of the invention will become apparent to those skilled in the art from the following detailed description of a preferred embodiment, especially when considered in light of the accompanying drawings.

DESCRIPTION OF THE PREFERRED EMBODIMENT

Figure 1:
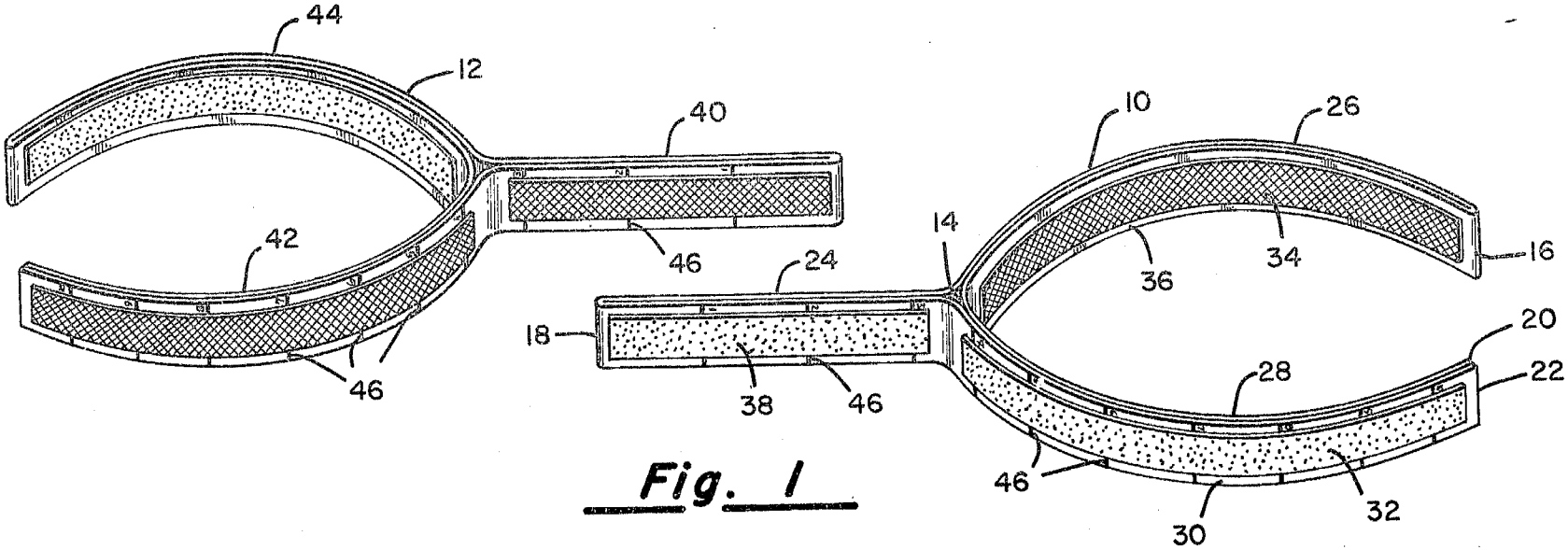
FIG. 1 is a perspective view of the cooperating parts of the preferred embodiment.

Referring first to FIG. 1, there is shown a first generally Y-shaped flexible strap member 10 and a somewhat similar strap member 12. The strap members 10 and 12 may be formed from any suitable flexible material, cotton webbing, leather, or suitable plastic being preferred.

As is shown in FIG. 1, the Y-shaped flexible members can be formed from a continuous length of suitable material of a predetermined width dimension by folding the material at the points identified by numerals 14, 16 and 18 respectively. That is, one free end of the strip identified by numeral 20 is folded first at point 14 and routed to end 16 where it is again folded back upon itself and extends to the end 18 where the strap is again folded upon itself and then routed against the course of the strap previously referred to as being between the points 20 and 14 and terminating at another free end 22. Thus, the individual strap members each comprise a stem portion 24 which is bifurcated at the point 14 so as to form two branches 26 and 28.

The two layers of strap material forming the stem 24 may be fastened together with a suitable adhesive or by stitching. Similarly, the courses of strap material defining the branches 26 and 28 may also be bound one to the other in the same manner.

Affixed to the outer surface 30 of the branch 28 is a first element 32 of a two-element separable fastener. The other element 34 of the two-element fastener is secured to the inside surface 36 of the branch 26.

The separable fastener element employed in the preferred embodiment is the mating hook and loop type fastener sold under the trademark Velcro. That is, the element 32 affixed to the outer surface of the branch 28 may comprise the hook fabric whereas the portion 34 affixed to the inside surface of the branch 26 may be the loop fabric. Attached to the side surface of the stem 24 to which the hook fabric 32 is attached is a corresponding segment of that fabric and in FIG. 1 it is identified by numeral 38.

The member 12 is substantially identical in its construction to the member 10 except that the stem portion 40 thereof has affixed to it the mating type of Velcro material used with the segment 38 affixed to the stem of the member 10. Similarly, the same type of fastener material as is used on the stem 40 is attached to the outside surface of the branch 42 of the member 12. Then, the opposite type of fastener fabric from that used on branch 42 is affixed to the inside surface of the branch 44.

It should also be noted in FIG. 1 that the outside surfaces of the strap members 10 and 12 are marked with graduation lines 46 along one branch and the stem thereof. As will be explained more fully, these graduations or markings assist the user in preparing the restraint to fit his own particular physique.

Figure 2:
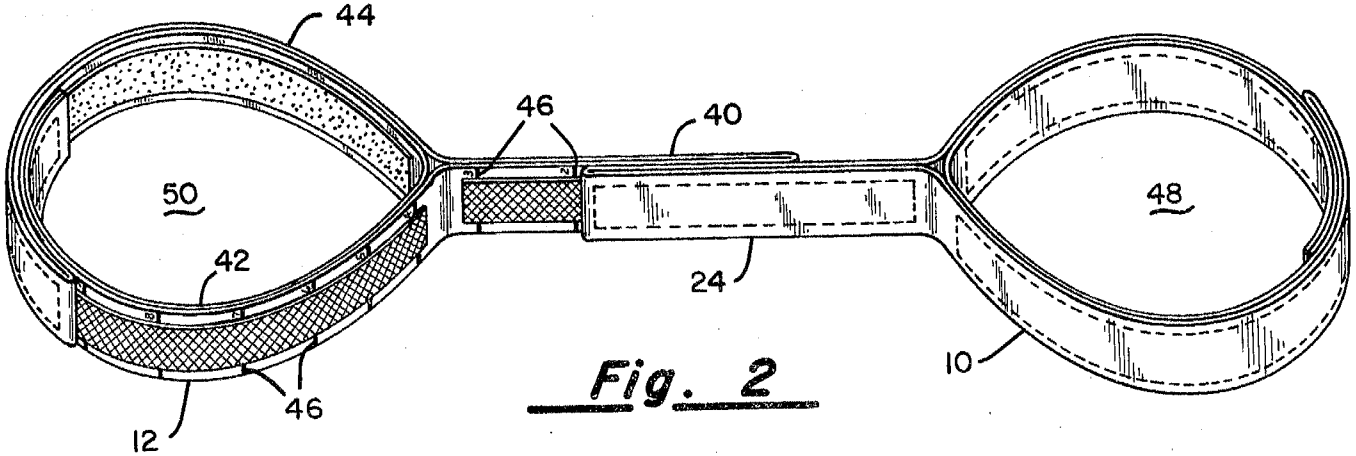
FIG. 2 illustrates the manner in which the parts may be joined to form the complete golf swing restraint device.

Referring now to FIG. 2, there is shown by means of a perspective view the manner in which the piece parts 10 and 12 of FIG. 1 are attached one to the other to form to the other so as to implement the golfer's arm restraint of the present invention. Member 10 in FIG. 1 is rotated 180° about a longitudinal axis passing through its stem portion 24 and brought into engagement with the stem portion 40 of the member 10. The hook elements of the Velcro fastener thus become entangled with the loop fabric on the stem of the member 12 holding the two pieces together. Similarly, the branches 42 and 44 of the member 12 are overlapped so that the two mating Velcro fastener elements affixed to them become coupled. In a like fashion, the branches 26 and 28 of the member 10 are overlapped so that the fastener member 32 becomes attached to the member 34. When so arranged, the interconnected branches form arm engaging loops 48 and 50.

In use, a golfer slips his two arms through the loops 48 and 50 until the loops engage the wearer's arms above the elbows. The degree of overlap between the stem portions 24 and 40 may be adjusted to comfortable fit persons of differing chest expanse. Similarly, the size of the loops 48 and 50 may be readily adjusted to fit around differing upper arm sizes.

Once comfortably positioned, the wearer may note the sizes as identified by the numbered indicia 46 formed on the separable members and can rapidly preassemble the restraint to fit himself after it has been used by another golfer.

The present invention is particularly well suited for use at public driving ranges where a golfer may go to improve his form by hitting a large number of balls in rather quick succession. By wearing the restraint device of the present invention, after a number of swings, he will develop a tendency to maintain his arms, especially his elbows, in a predetermined orientation even after the restraint has been removed. In effect, then, the apparatus of the present invention permits the golfer to get his swing "in the groove", so to speak.

Because the present invention may be fabricated from a variety of different materials and because the positioning of the elements of the two-element separable fasteners can be oriented in different manners while still achieving substantially the same end result, it should be understood that the scope of the invention is to be determined from the following claims.

What is claimed is:

1. A restraint device for use in improving a golfer's swing, comprising:

(a) first and second Y-shaped, flexible strap members each having a stem portion and two branch portions extending from said stem portion, there being a strip of fabric having one element of a two-element Velcro fastener affixed to the inside surface of one branch of each of said Y-shaped strap members and a strip of fabric having the other element of a two-element Velcro fastener affixed to the outside surface of the other branch of each of said Y-shaped strap members; and (b) further Velcro strip fastener means for separably joining said stem portions of said first and second Y-shaped strap members together with the branch portions of each generally extending in opposite directions, the arrangement being such that when said elements of said separable fasteners are engaged, said branch portions form segments of arm engaging loops.

2. Apparatus as in claim 1 wherein the sizes of said arm engaging loops are adjustable.

3. Apparatus as in claim 1 wherein said stem portion and at least one of said branch portions of each of said Y-shaped strap members includes graduated marking indicia for facilitating the sizing of said restraint device.

* * * * *